United States Patent [19]

Rodriguez

[11] Patent Number: 4,821,474

[45] Date of Patent: Apr. 18, 1989

[54] POST-TENSIONING ANCHOR

[76] Inventor: Alan Rodriguez, 3025 Montego, Plano, Tex. 75023

[21] Appl. No.: 88,795

[22] Filed: Aug. 24, 1987

[51] Int. Cl.[4] ..... E04C 3/10

[52] U.S. Cl. ..... 52/223 L; 24/122.6

[58] Field of Search ..... 52/223 L, 230, 699, 52/227; 24/122.6; 264/228

[56] References Cited

U.S. PATENT DOCUMENTS

| | | | |
|---|---|---|---|
| 3,289,379 | 12/1966 | Watts | 52/699 X |
| 3,833,706 | 9/1974 | Edwards | 52/230 X |
| 4,363,462 | 12/1982 | Wlodkowski et al. | 24/122.6 X |
| 4,561,226 | 12/1985 | Tourneur | 52/223 L |
| 4,616,458 | 10/1986 | Davis et al. | 52/223 L |
| 4,621,943 | 11/1986 | Swanson | 264/228 X |

*Primary Examiner*—Carl D. Friedman

*Attorney, Agent, or Firm*—Thomas L. Cantrell; Stanley R. Moore

[57] ABSTRACT

A post tensioning anchor assembly comprising a tapered tubular member, cable cap and anchoring plate assembly. The anchoring plate is constructed for live end or dead end securement in the sidewall of a concrete formation for post tensioning of a sheathed cable. The plate has inside and outside faces constructed for matingly receiving over the cable either the tubular member cap or both. In this manner the post tensioning plate assembly can be used for both outside and intermediate post tensioning constructions. In the intermediate configuration, tubular members are secured both to the inside and the outside faces of the plate with the tensioning cable extending therethrough.

14 Claims, 1 Drawing Sheet

POST-TENSIONING ANCHOR

BACKGROUND OF THE INVENTION

1. Field of the Invention

The present invention relates to post-tensioning concrete anchor assemblies and, more particularly, to an anchor plate assembly adapted for both terminal end and intermediate anchor utilization.

2. History of the Prior Art

The prior art is replete with anchor plate assemblies adapted for the securement of post-tensioning tendons thereto for the tensioning of concrete structures. Engineering in the post-tensioning of concrete is a well developed technology and the utilization of such tendons extending through a concrete slab or beam is conventional. The tendons provide structural strength for the concrete in a manner and at a cost not heretofore possible with conventional rebar construction. Utilization of such tendons does, however, require anchor assemblies on opposite ends thereof. The anchor assemblies secure the ends of the tendons extending through the concrete bed and must remain effective during the lifespan of the construction. The effectiveness requires the protection of the tendons which are usually made of steel or the like, from corrosion. Corrosive forces are well known to cause deterioration in the strength of the concrete if allowed to jeopardize the integrity of the tensioning member. To prevent corrosion of the tendon, the steel fibers are usually sheathed in a plastic membrane throughout the length of the slab. The membranes do, however, require termination at the point where the tendons are secured within the anchor assemblies. The reason is obviously to provide appropriate structural integrity at the secured position.

In the process of post-tensioning, it is important that the tendon is free to move within the hardened concrete so that the tensile load on the tendon is evenly distributed along the entire length of the structure. Methods used to assure that the tendons provide free movement within hardened concrete include laying a number of strands of wire in a duct or tube. It is within this duct or tube that the strands of wire are stressed after the concrete is hardened. The duct or tube may be formed of metal or plastic and is usually filled with grease. The prior art also includes parallel strands of wire covered with grease and then covered with spirally wound paper. In some cases the wound paper is replaced by wound or wrapped plastic. Just the opposite is true of prestressing concrete cables. The cables are generally exposed to the concrete and are not covered with the sheath due to the fact that it is important that the concrete bond directly to the metal cable in its prestressed condition. Once the forms are set, the tension in the cable is also established so that once the concrete cures it forms a bond directly to the cable and no cable movement is allowed without movement on the concrete itself. There are, of course, advantages to both systems depending on the type of fabrication utilized in the ultimate application.

The present invention pertains to the anchor assemblies utilized in post tensioning configurations. Prestressing configurations do not require such anchor assemblies because the cables are cemented in the concrete and can simply be cut off. Post tensioning, however, incorporates the duct or plastic tube as described above and the utilization of anchors from opposite ends to produce the tensile force transmitted therethrough.

Several prior art patents address such anchor assemblies for the post tensioning of a tendon in a concrete structural component. U.S. Pat. No. 4,363,462 issued to Wlodkowsi et al. on Dec. 14, 1982 teaches one such anchor assembly. This particular structure also incorporates a recoverable part having an axially elongated sheath which closely encloses a tendon over a portion on the length of the sheath. When assembled in the formwork, one end of the sheath is arranged to be located within the concrete when it is poured and the other end is located on the exterior of the formwork. By removing the fastening means after the concrete has been poured, it is possible to remove the form and a cup member formed integrally with the sheath to form at least a portioned recess in the concrete member. Tensioning is then provided by conventional means with the tendons secured by wedges or the like in an orifice formed in the anchor plate. As set forth in this reference, it is an important consideration that the tendons be sufficiently protected against corrosion and this is affected by enclosing them in a plastic coating. It is likewise important to cover all areas of the tendon to provide protection against corrosion anywhere therealong. The most sensitive area of corrosion is in the vicinity of the locking wedges in the anchor plate and, therefor, that too is an area for which a sealant or covering must be applied. It may thus be seen that great care has been afforded the prior art structures by providing threaded and similar sealed engagement between the sheath coverings and the anchor assemblies.

There are numerous other approaches to post tensioning anchors for prestressed concrete as set forth and shown in the prior art. U.S. Pat. No. 4,121,325 to Bruinette et al. is a 1978 reference which teaches an anchor and coupling unit for use with stressing cables and reinforced concrete structures. In this particular embodiment the cable anchoring equipment addresses both pretensioned or post-tensioned, prestressed cementuous structures. As stated above, protective sheaths are located around the cables so that the latter may elongate under tension within the concrete. One end of the cable is anchored to the structure and this end is called the dead end. The other end of the cable called the "live end" includes a cable anchor on which the tensioning force may be applied. As discussed, it is necessary to protect both the dead and live anchoring ends of the cables because at these points the sheathing must be peeled back to enable the locking wedges or jaws of the tensioning mechanism to directly engage the cable. When the sheathing is stripped back it is necessary then to protect the cable because the strain induced upon the cable by the clamping jaws and/or wedges is in the area in which corrosion will first manifest itself. Failure at this area means failure in the tensioning cable. Of primary consideration, however, is not simply the anchor assembly that is used on opposite ends of a concrete slab, beam or similar poured structure. It is well known to seal, grout or likewise cap the ends of the post-tensioning cables. Problems often arise when a series of contiguous slabs or structural members are poured seriatim with a continuous cable extending therethrough. Due to the length of the member, sections must be poured in discrete quantities and then individually post-tensioned. Once applied, the second, contiguous section, must likewise be post-tensioned after pouring. This requires the utilization of an anchor or coupling assembly which allows both the post-tensioning of the first slab as well as the continuation of the tendon through the second slab or beam and the post-tensioning thereof. Such assemblies must also facilitate constructional mandates relative to the ease of use, cost and number of parts available for various jobs. A single anchor assembly which is adapted for both external and intermediate use and which is constructed for protecting the sheath cable for post-tensioning in the manner described above is a very necessary step.

The present invention provides an advance over the prior art by providing a post-tensioning anchor assembly that may be used for post-tensioning concrete either at a terminal end or in an intermediate position. A connector tube of the present invention is adapted for engaging the anchor body on either the front or rear. Two caps are also provided (live end and dead end caps) with the same dimension as the connector tube whereby the caps can be used when the anchor serves as the terminal end of the tensioning cable. Similarly the tube can be used when the anchor is disposed as an intermediate element in a seriatim pour. By allowing the anchor plate to be constructed for receiving tubular elements in press fit, frictional engagement on opposite ends thereof and/or with a mating cap configuration depending on the particular application, the present invention affords the protection reliability, and feasibility in an anchor package that is economical to fabricate and inexpensive to use in post-tensioning operations.

SUMMARY OF THE INVENTION

The present invention pertains to a tendon anchoring system and method therefor. More particularly, one aspect of the invention comprises an improved post-tensioning anchor plate of the type constructed for securement to a concrete structure and the receipt of a tensioning cable therethrough. The anchor plate includes means for securing the tensioning cable therein in taught engagement. The improvement comprises an anchor plate housing having first and second faces, the first face being adapted for facing the poured concrete structure with the second oppositely disposed face adapted for facing outwardly therefrom. The anchor plate housing is constructed with a central aperture formed therethrough, the aperture having a first collar region formed on the first face and a second collar, or central body region formed on the second face. The first and second collar regions are concentrically aligned one with the other. At least one tubular sheath is provided and adapted for engagement with the first anchor plate face for extension outwardly therefrom into the concrete with the tendon extending therethrough. The first collar region also has a tubular receiving surface with an outside diameter substantially equivalent to the inside diameter of the tubular member and adapted for the slip fit engagement thereagainst for the sealing of the tendon therein. The second collar region includes a tubular engaging region of substantially equivalent diameter to the first collar tubular engaging region for permitting securement of a second tubular member or a cylindrical cap member thereon.

In another aspect, the invention includes an improved anchor plate of the type utilized for securement in a concrete structure and the receipt of a post-tensioning tendon therethrough. Means are provided for fixedly securing the tendon therein. At least one tapered, tubular extension member is provided for securement to the plate for extending into the concrete in protection of the tendon adjacent the anchor plate. The improvement comprises the anchor plate being constructed with first and second tubular receiving portions disposed on opposite sides thereof and having a central aperture formed therethrough for receipt of the tendon therein. The tubular receiving portions are constructed in axial alignment and have cylindrical body portions adapted for the slip fit sealing engagement of the tubular members on each side thereof. Two types of cylindrical caps each has an inside diameter substantially equivalent to the inside diameter of the tubular member for sealing engagement upon one side of the anchor plate. This allows both live end and dead end termination of the tendon therein and the sealed securement thereof. A second tubular member is adapted for slip fit, sealed engagement on the anchor plate in place of the cap for permitting the extension of a tension cable from the first tubular member extending through the anchor plate and through the second tubular member. This allows the anchor plate to be disposed within first and second, contiguous concrete sections poured on opposite sides thereof and post-tensioned with the tendon extending therethrough as well as improved tendon terminations.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
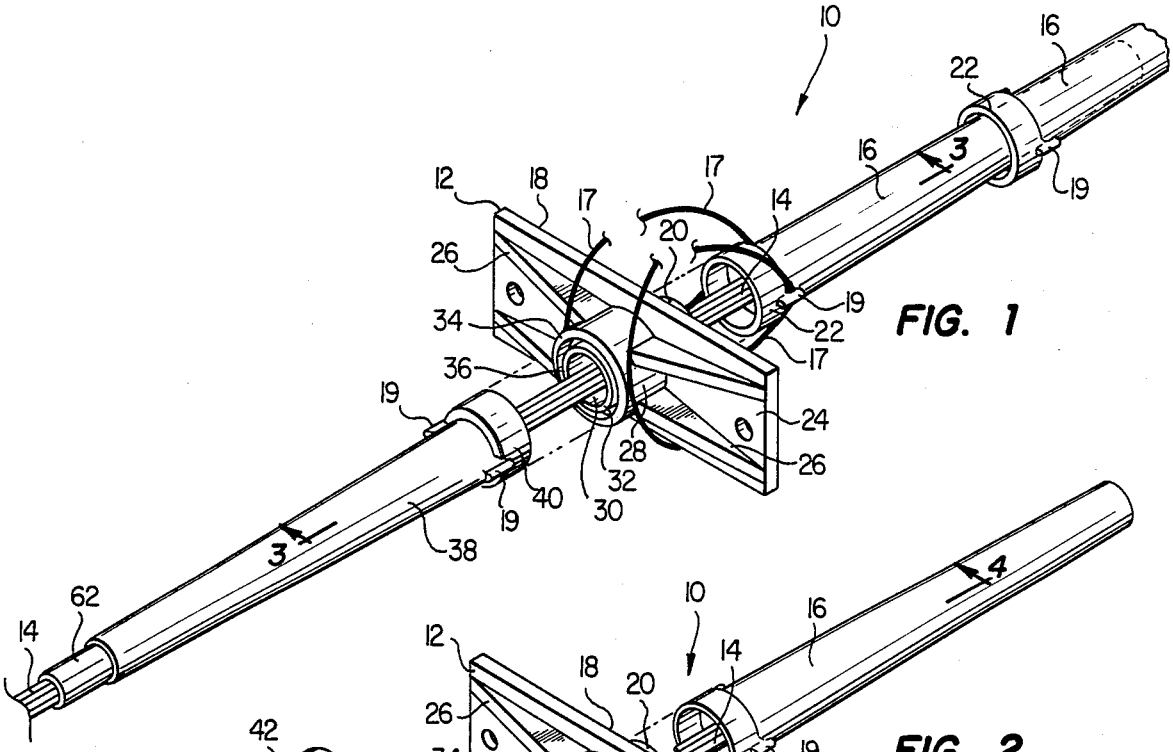
FIG. 1 is an exploded, perspective view of one embodiment of an anchor plate assembly constructed in accordance with the principles of the present invention.

Referring first to FIG. 1 there is shown an exploded perspective view of an anchor plate assembly constructed in accordance with the principles of the present invention. The anchor plate assembly 10 comprises a generally rectangular anchor plate 12 through which a sheathed post-tensioning tendon 14 extends. The tendon 14 of FIG. 1 is shown extending through the anchor plate 12 for purposes of illustration. The tendon 14 is further shown disposed within a series of removable tapered, tubular members 16 which attaches to the rear face 18 of the plate 12. A second, identical tubular member 38 is shown and discussed below. It is against the rear face 18 that the tensioning face applied to a concrete structure is generated by the post-tensioning cable 14. The tapered tubular member 16 is secured about a collar region 20 extending from the inside face 18 of the plate 12 in sealed engagement of the tendon 14 therein. Any number of tubular members 16 can be used by stacking them one upon another, in a "telescoping" type assembly. This also holds true for storage and shipping of tubular members 16 and 38, which are identical in size and shape and stackable one upon the other.

Referring still to FIG. 1, a cylindrical cup shaped region 22 of enlarged diameter is provided at the distal end of each tubular member 16 for engagement of the cylindrical collar 20 in slip fit frictional relationship. Appropriate sealing compounds and the like are used upon the cable 14 and around the collar 20 a is conventional in the prior art of post-tensioning systems whereby the tendons 14 are sealed from the concrete and from other sources of corrosion.

Still referring to FIG. 1 there is shown the front face 24 of the anchor plate 12. The front face 24 of the present embodiment is constructed with a series of gussets 26 tapering downwardly from a central cylindrical body section 28. The section can be formed without gussets 26 as needed for the particular application. The central body section 28 is constructed of somewhat larger size relative to the collar member 20 formed on the inside face 18 of the plate 12 but in axial alignment therewith. An aperture 30 is likewise formed centrally through the body portion 28, plate 12 and collar region 20 whereby tendon 14 may be received therein. The larger central body portion 28 is cylindrical in construction and comprises an inner wall 32 and an outer wall region 34. An annular region 36 is formed between said inner and outer walls which annular region 36 is adapted for receipt of a tubular member 38, being of substantially identical construction to tubular member 16. Optional securing filaments 17, which may in the form of wires or plastic straps, secure the tubular member 16 to anchor plate 12. Connecting ears 19 formed on opposite sides of tubular member 16 receive the optional filaments 17 therearound. As described in more detail below this design affords numerous benefits including securement of tubular member 16 to plate 12 during pours, the interchangeability of components, cost savings and application flexibility in the anchor plate assembly 10 because said assembly can be utilized as an external anchoring unit or an intermediate anchor plate.

Referring still to FIG. 1, the anchor plate 12 may be adapted for use as a terminal anchor plate outwardly of a concrete structure or as an intermediate anchor plate due to the feasibility for receiving the tubular members 16 and 38 on opposite sides thereof. The concrete structure is defined by pour forms 99 described in more detail below. The cylindrical cup shaped region 22 of tubular member 16 and cylindrical cup shape region 40 of member 38 are of the identical size and shape and are each adapted to fit in press fit, frictional engagement with the respective mating services of the plate 12. Cup region 22 is thus formed with an inside diameter slightly greater than the outside diameter of collar region 20 so that a press-slip fit interengagement is facilitated. The annular region 36 is adapted for receiving the cup shape region 40 wherein the outside surface of inner cylindrical wall 32 has a diameter somewhat less than the inside diameter of the cup shape member 40. Likewise the outside diameter of the cup shape member 40 is slightly less than the inside diameter of the outside wall 34 whereby press fit interengagement is again facilitated and the tendon 14 is protected therein.

Figure 2:
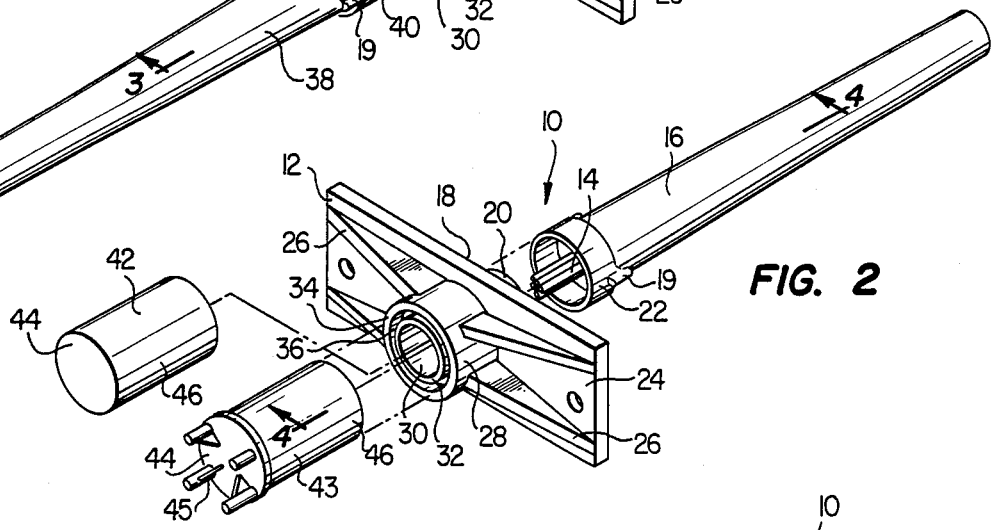
FIG. 2 is an exploded, perspective view of an alternative embodiment of the anchor plate assembly of FIG. 1 constructed in accordance with the principles of the present invention.

Referring now to FIG. 2 there is seen the anchor plate 12 of the present invention wherein tubular member 16 is again shown covering tendon 14 therein. The plate 12 includes an inside surface 18 having a collar region 20 formed thereon and extending outwardly thereof. Likewise, central body region 28 is constructed as described above for receiving the tendon 14 therethrough. However, in the embodiment shown in FIG. 2, the second tubular member 38 can be replaced with one of two cap members 42 and 43. The cap members 42 and 43 include a disk shaped ends 44 and cylindrical body regions 46. The cylindrical body region 46 has substantially the same diameter as the cup shape region 40 of tubular member 38. In this manner, the caps 42 and 43 are able to be received in the annular recess 36 for sealing the terminal end of a tendon 14 within the orifice 30. As described in more detail below cap 43 includes at least one and preferably a plurality of feet 45 for use in a "dead end" position. In this position the feet 45 are pressed against the inside of form 99 and the cap 43 pressed firmly against the anchor plate 12. This constitutes positive spacing of the anchor plate 12 from the form 99 and the ultimate face of the concrete 58. The length of the feet 45 may vary to accommodate specifications for concrete cover required in a given application. In these configurations, the anchor assembly 10 of FIG. 2 may be used at either the live or dead terminal end of a concrete structure wherein the tendon 14 is used for post tensioning said structure and terminated and secured at the anchor plate 12 as shown. It can thus be seen that the anchor plate 12 is capable of intermediate or terminal end applications while facilitating total interchangeability of appropriate parts such as tube 38, cap 42, or cap 43. Versatility and reliability are then provided in a most economical assembly.

Figure 3:
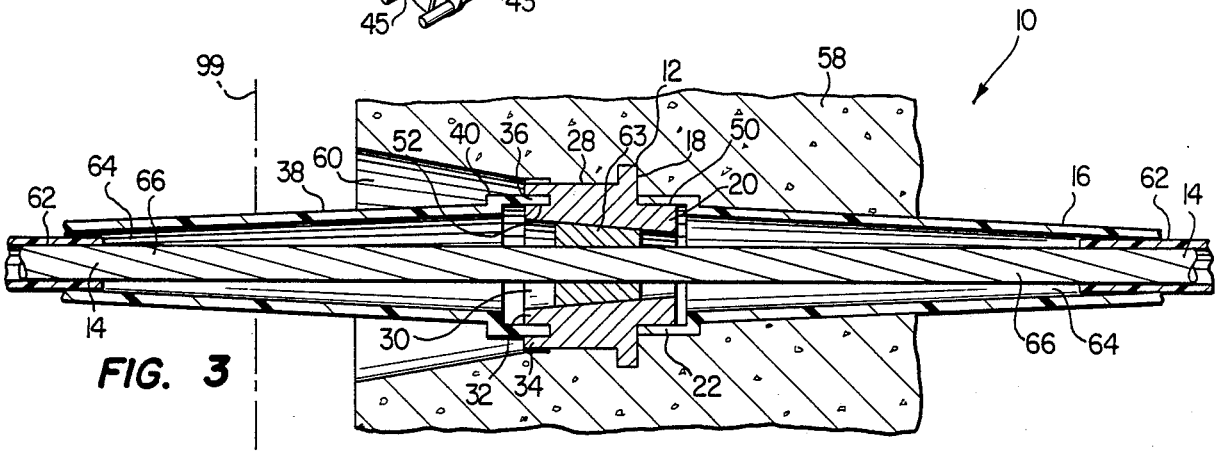
FIG. 3 is a side-elevational, cross-sectional view of the anchor plate assembly of FIG. 1 taken along line 3—3 thereof and illustrating the assembled configuration within a concrete structure.

Referring now to FIG. 3 there is shown a side-elevational, cross-sectional view of the assembled anchor plate 10 of FIG. 1. The tendon 14 is shown to have a sealing surface 50 between the inside wall of the cup shaped region 22 and outside wall of the collar region 20 at the end of the tubular member 16. The same holds true for tubular member 38 which forms a sealing surface 52 within the annulus 36. This particular embodiment of concrete structure 58 is shown poured around the tendon 14 and around tubular member 16 prior to a second pour around tubular member 38. This would be the situation with the anchor plate 12 used in an intermediate anchor position. A cavity 60 is formed around the end of plate 12 by a "pocket former" (not shown), which cavity permits access to the plate 12 to attach tubular member 38 or cap 42, 43 as the application mandates.

Still referring to FIG. 3, it may be seen that the tendon 14 itself is constructed with a protective sheath 62. The sheath 62 is cut away in the portion of the tendon 14 that engages the anchor plate 12, as shown in FIGS. 1–4. This is to allow tensioning and/or placement of securement wedges 63 within the bore 30 of the anchor plate 12. The wedges 63 are tapered as is the bore of the anchor plate 12 for securing the tendon 14 against movement after post-tensioning. In the embodiment of FIG. 3 the sheath 62 is shown removed from the tendon 14 in the intermediate section between the tubular sheaths 38 and 16. An annular bore 64 is thus formed around the raw cable strands 66. The raw strands 66 of tendon 14 are shown to be in direct engagement with the anchoring wedges 63 as is conventional in such constructions.

Figure 4:
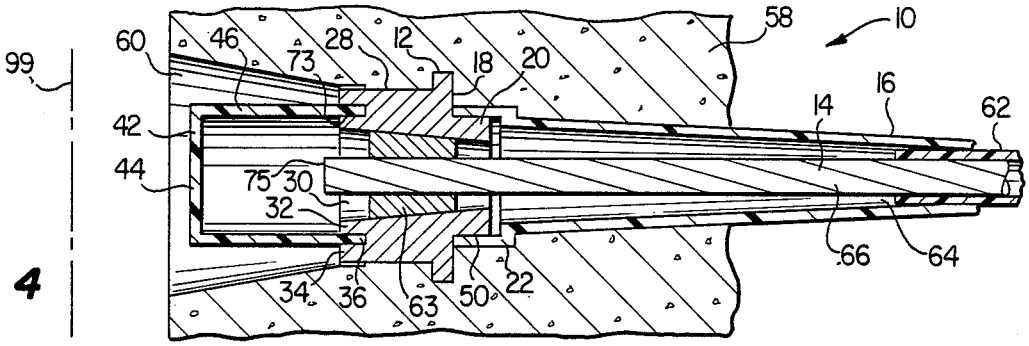
FIG. 4 is a side-elevational, cross-sectional view of the anchor plate assembly of FIG. 2 taken along lines 4—4 thereof and illustrating the assembled configuration within a concrete structure.

Referring now to FIG. 4 there is shown a side-elevational, cross-sectional view of the exploded anchor assembly 10 of FIG. 2 in an assembled configuration. As assembled, the tendon 14 is terminated at an end 75 within one of the caps 42 and 43. Cap 42 is used with a "live end" configuration where the tendon 14 is tensioned and then secured by wedges 63. A "dead end" is that tendon termination point where the tendon 14 is first secured with wedges 63, or the like, and sealed within the pour of concrete. It then forms the cable end against which tensioning occurs. The feet 45 of dead end cap 44 are used to seat the cap 44 against the concrete pour forms shown by phantom lines 99 in FIGS. 3 and 4. The concrete pour forms 99 define the size and shape of the structure 58. The feet 45 also provided "ears" to secure optional filaments 17 as shown in FIG. 1 which provides an assembly that will not come apart during the pour.

Referring still to FIG. 4, the body 46 of caps 42 and 43 is shown to be of the same size as cylindrical cup member 40 of removable tubular member 38 whereby it is received within the annulus 36 of the central body region 28 to form a sealing surface 73 therein. Sealing surface 73 is created to prevent moisture and the corrosive material from attacking distal end 75 of the tendon 14 which, as described above, is stripped back for exposing the raw strands 66 as shown herein. The sheath 62 is cut back into that region as shown in FIG. 4 and is very susceptible to corrosion in that area. Because the wedges 63 provide the only means for securing the tendon 14 in the anchor plate 12 it is important that no corrosive forces are allowed to develop. In this particular embodiment various materials can be utilized to further seal the sealing surfaces in and around the cap and the cap itself can be sealed within the cavity 60 as it forms the terminal end of the post-tensioning cable 14 in accordance with the present invention.

In operation, a post-tensioning cable 14 is placed within forms 99 where the anchor plates 12 are secured. The tubular member 16 and cap 43 are secured to the plate 12 by optional filaments 17 when needed. After concrete has been poured, tensioning is imparted against a "dead end" and the tendon 14 may then be cut and capped as shown in FIG. 4. It may, instead be placed in a position for a second pour as shown in FIG. 3. With a second tubular member 38 utilized. In this manner a single anchor plate 12 can be utilized with either tubular member 16 or 38 on opposite sides thereof or the tubular member 16 on one side and one of the caps 42 or 43 on the other to allow a wide range of flexibility in a construction technique which has found widespread acceptance in the construction industry. By utilizing press fit interengagement, the application of sealants is facilitated and the effectiveness of such sealants is greatly enhanced because the surfaces are dimensioned to maximize sealing and preventing corrosion. In the case of the dead end or live end discussed above, friction fit is allowed which greatly reduces the cost of both fabrication and use. The substitution of either a cap or a tubular member which is made water tight is clearly an advance over the prior art as is a tubular member that will friction fit either the front or rear of an anchor plate 12.

Still referencing the operation of the present invention, a myriad of applications are possible as set forth herein. The tapered tubular members 16 and 38 provide means for facilitating handling and storage of said tubular members. Because of their fabrication from plastic or the like and the sizing for pressfit engagement with the anchor plate 12, both the ease and the reliability of the sealed surface therebetween is improved. As described above, the integrity of the sealed surface between the caps 42, 43 and tubular members 16 and 38 is of tantamount import. If the integrity of the sealed surface is broken, corrosion can set in. The utilization of this configuration greatly reduces the amount of grease necessary for maintaining the sealed configuration. The availability of the telescoping tubular sections 16 and 38 also allows quick correction on the job if sheathing of a tensioning cable 14 has bee- stripped back too far. The application of a second tubular member 16 on top a first with a greased joint therebetween eliminates the need for replacement of the cable. This is a very significant attribute of the present invention from the standpoint of operation. Moreover, the utilization of the optional filament 17, which is preferably wire, maximizes the shipping, handling and pour efficiency of the post-tensioning anchor. With the tubular members or caps secured to the plate 12 by the optional filament 17, the problem of a dislodged part and a loose seal is advantageously eliminated.

Finally, it should be noted that it is possible to make the tubular members 16 and 38 as described herein from an injection molded process without the need to match threads for watertight closures as in many prior art configurations. The problem of holding tolerances normally found in threaded and/or cast elements conventional in the prior art is thus not present. The utilization of a press fit, frictional connection allowing the incorporation of both lubricant and sealant may thus be seen to provide a substantial advance over the prior art not heretofore possible.

It is thus believed that the operation and construction of the present invention will be apparent from the foregoing description. While the method and apparatus shown and described has been characterized as being preferred, it will be obvious that various changes and modifications may be made therein without departing from the spirit and scope of the invention as defined in the following claims.

What is claimed is:

1. An improved post-tensioning anchor plate assembly of the type constructed for securement in a concrete structure, defined by pour forms and the receipt of a tensioning tendon therethrough, having means for securing said tensioning tendon therein in taut engagement, wherein said improvement comprises:

an anchor plate housing having first and second faces, said first face being adapted for facing inwardly toward said concrete with said second oppositely disposed face adapted for facing outwardly therefrom;

said anchor plate housing further being constructed with a central aperture formed therethrough, said aperture having a first collar region formed on said first face and a second collar region formed on said second face, said first and second collar regions being concentrically aligned one with the other;

a tubular member adapted for engagement with said first anchor plate face for extension outwardly therefrom into said concrete with said tendon extending therethrough;

said first collar region having a first tubular engaging surface with an outside diameter substantially equivalent to an inside diameter of said tubular member and adapted for the press fit engagement thereof for the sealing of said tendon therein; and said second collar region having a second tubular member engaging surface of substantially equivalent diameter to said first tubular member engaging surface for permitting securement of a second member thereon.

2. The apparatus as set forth in claim 1 wherein said second member adapted for securement to said second collar of said second face of said anchor plate comprises a second tubular member adapted for receiving said tendon therethrough with said tendon extending through said anchor plate and said first tubular member.

3. The apparatus as set forth in claim 1 wherein said second member adapted for securement to said second collar of said second face of said anchor plate comprises a cylindrical cap adapted for covering and sealing the end of said tendon therein.

4. The apparatus as set forth in claim 3 wherein said cap is constructed with at least one foot extending outwardly therefrom for abuttingly engaging said pour forms while said cap is secured to said anchor plate for positively spacing said anchor plate from said pour forms.

5. The apparatus as set forth in claim 1 wherein said anchor plate is constructed with a generally planar body section, said first face of said anchor plate adjacent said first collar region being substantially planar for flush engagement with said concrete structure.

6. The apparatus as set forth in claim 1 wherein said first and second collar regions extending from said first and second faces of said anchor plate comprise generally cylindrical members upstanding from said anchor plate in coaxial alignment, said second collar region being formed with an annular recess therein, an inside wall of said annular recess comprising said second tubular engagement surface.

7. The apparatus as set forth in claim 1 wherein said tubular member is of an elongate construction having a hollow, tapered tubular shape facilitating stacking one upon the other.

8. The apparatus as set forth in claim 7 wherein said anchor plate assembly further includes a filament and said tubular member includes at least one ear formed thereon adapted for receipt of said filament therearound for facilitating the securement of said tubular member to said plate.

9. The apparatus as set forth in claim 1 and further including at least one filament member for positioning upon and extending around said anchor plate and around said tubular member for securing said tubular member to said plate.

10. An improved anchor plate assembly of the type utilized for placement in a concrete structure defined by pour forms and the receipt of a post-tensioning tendon therethrough with means for fixedly securing said tendon therein and further including at least one tubular extension member having a base region adapted for securement to said anchor plate for extending into said concrete in protection of said tendon adjacent said anchor plate, wherein the improvement comprises:

said anchor plate being constructed with first and second tubular receiving portions disposed on opposite sides of said anchor plate and having a central aperture formed therethrough for receipt of said tendon therein;

said tubular receiving portions constructed in axial alignment and having cylindrical body portions adapted for the pressfit sealing engagement of said base region of said tubular member thereon;

at least one cylindrical cap having an inside diameter substantially equivalent to the inside diameter of said base region of said tubular member for sealing engagement upon one side of said anchor plate to allow selective termination of said tendon therein with the sealed securement thereof; and a second tubular member adapted for slip fit sealed engagement on said anchor plate in place of said cap for permitting the extension of a tension cable from said first tubular member extending through said anchor plate and through said second tubular member for allowing said anchor plate to be disposed intermediately within said concrete structure.

11. The apparatus as set forth in claim 10 wherein said cylindrical cap is constructed with at least one foot extending outwardly therefrom for abuttingly engaging said pour forms while said cup is secured to said anchor plate for positively spacing said anchor plate from said pour forms.

12. The apparatus as set forth in claim 11 wherein said cap is constructed with a plurality of feet extending outwardly therefrom for abuttingly engaging said pour form.

13. The apparatus as set forth in claim 10 wherein said second tubular member is constructed in a substantially tapered configuration for facilitating stacking said tubular members one upon the other.

14. The apparatus as set forth in claim 10 wherein said anchor plate assembly further includes a filament and said second tubular member includes at least one ear formed thereon for receipt of said filament therearound and the securement of said tubular member to said anchor plate.

* * * * *